US012703968B2

(12) United States Patent
Tinker et al.

(10) Patent No.: US 12,703,968 B2
(45) Date of Patent: Aug. 11, 2026

(54) FAUCET ASSEMBLY AND DISPENSING APPLIANCE

(71) Applicant: Kohler Co., Kohler, WI (US)

(72) Inventors: Patrick Tinker, Sheboygan, WI (US); Jacob Frye, Sheboygan Falls, WI (US); Matthew Tyler Harrison, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 18/761,699

(22) Filed: Jul. 2, 2024

(65) Prior Publication Data

US 2025/0019946 A1 Jan. 16, 2025

Related U.S. Application Data

(60) Provisional application No. 63/513,093, filed on Jul. 11, 2023.

(51) Int. Cl.
*E03C 1/05* (2006.01)
*E03C 1/04* (2006.01)

(52) U.S. Cl.
CPC ..... *E03C 1/055* (2013.01); *E03C 1/0405* (2013.01); *E03C 2001/0415* (2013.01); *E03C 2201/45* (2013.01)

(58) Field of Classification Search
None
See application file for complete search history.

(56) References Cited

U.S. PATENT DOCUMENTS

| | | | | |
|---|---|---|---|---|
| 8,162,236 | B2 | 4/2012 | Rodenbeck et al. | |
| 8,376,313 | B2 * | 2/2013 | Burke | E03C 1/057 327/517 |
| 8,613,419 | B2 * | 12/2013 | Rodenbeck | E03C 1/055 251/129.03 |
| 8,671,979 | B2 | 3/2014 | Gioira et al. | |
| 8,944,105 | B2 * | 2/2015 | Rodenbeck | E03C 1/057 137/801 |
| 8,973,612 | B2 * | 3/2015 | Sawaski | E03C 1/055 137/1 |
| 9,062,790 | B2 * | 6/2015 | Esche | F16K 31/02 |
| 9,074,698 | B2 * | 7/2015 | Esche | F16K 19/006 |

(Continued)

FOREIGN PATENT DOCUMENTS

| | | | |
|---|---|---|---|
| WO | 2022/067389 | A1 | 4/2022 |
| WO | 2022/173889 | A1 | 8/2022 |

*Primary Examiner* — Matthew W Jellett
(74) *Attorney, Agent, or Firm* — Husch Blackwell LLP

(57) ABSTRACT

A faucet assembly and methods of constructing a faucet assembly. The faucet assembly includes a spout, a base, a puck, and a dispensing appliance. The puck includes a user interface and a wheel, both configured to be manipulated by a user to control the settings and output of the faucet assembly. The dispensing appliance is configured to be stored beneath the surface to which the faucet assembly is installed. The dispensing appliance comprises a water inlet and various water processing components, including but not limited a filter, a chiller, a heater, and a carbonator. The dispensing appliance is configured to process water from the water inlet according to a command by the user on the user interface or wheel, and dispense the water through the spout of the faucet assembly.

20 Claims, 4 Drawing Sheets

(56) References Cited

U.S. PATENT DOCUMENTS

| | | | | |
|---|---|---|---|---|
| 9,243,756 | B2 * | 1/2016 | Davidson | H05K 13/00 |
| 9,285,807 | B2 | 3/2016 | Rodenbeck et al. | |
| 9,715,238 | B2 | 7/2017 | Rodenbeck et al. | |
| 9,777,470 | B2 * | 10/2017 | Mazz | E03C 1/055 |
| 9,783,964 | B2 * | 10/2017 | Thompson | G05B 15/02 |
| 10,161,116 | B2 * | 12/2018 | Frye | E03C 1/04 |
| 10,183,871 | B2 | 1/2019 | Ye | |
| 10,184,230 | B2 * | 1/2019 | Lev | F16K 31/1262 |
| 10,450,203 | B2 * | 10/2019 | Schuster | C02F 1/003 |
| 10,450,732 | B2 | 10/2019 | Xia | |
| 10,472,252 | B2 | 11/2019 | Schuster | |
| 10,626,583 | B2 * | 4/2020 | Mazz | A47K 3/281 |
| 10,640,393 | B2 * | 5/2020 | Cobb | E03C 1/0411 |
| 10,675,573 | B2 | 6/2020 | Miller et al. | |
| 10,698,429 | B2 | 6/2020 | Rodenbeck et al. | |
| 11,001,509 | B2 | 5/2021 | Schuster | |
| 11,189,445 | B2 * | 11/2021 | Yang | E03C 1/326 |
| 11,261,587 | B2 | 3/2022 | Rosandich et al. | |
| 11,542,693 | B2 | 1/2023 | Hirsch | |
| 2020/0263400 | A1 | 8/2020 | Song et al. | |
| 2020/0326734 | A1 | 10/2020 | Rodenbeck et al. | |
| 2021/0388584 | A1 * | 12/2021 | Thomas | F16K 31/041 |
| 2022/0040712 | A1 | 2/2022 | Erickson | |
| 2022/0049479 | A1 | 2/2022 | Mainka et al. | |
| 2022/0098837 | A1 | 3/2022 | Pitsch et al. | |

* cited by examiner

FAUCET ASSEMBLY AND DISPENSING APPLIANCE

RELATED APPLICATIONS

The present application claims the benefit of U.S. Provisional Application Ser. No. 63/513,093, filed Jul. 11, 2023, which is incorporated herein by reference in its entirety.

TECHNICAL FIELD

Examples relate generally to the field of faucets for dispensing liquids, and more specifically this application relates to beverage and primary faucets dispensing liquids in multiple formats such as filtered, carbonated, instant hot (near boiling), and cold filtered.

BACKGROUND

Traditional faucets are limited to dispensing liquids from cold and hot water inlets, typically unfiltered water, configured to control the temperature of the water via mixing valves. In kitchens, residential or commercial, there is a need for a faucet system that is configured to dispense not just hot and cold tap water, but other types of water. For example, a faucet that can, in addition to tap water, dispense filtered water, boiling or near boiling water, chilled filtered water, carbonated water, other types of treated water, and combinations thereof.

There are systems configured to dispense one of these types of liquids, such as an auxiliary or beverage faucet, in addition to a primary faucet, that dispenses water readily, such as filtered or boiling water. However, there is no system that can serve as a primary faucet assembly that dispenses both unfiltered, temperature-controlled tap water and filtered or carbonated temperature-controlled water, or a beverage faucet assembly that dispenses filtered water that can be near boiling, chilled, carbonated, or the like. There is need for a faucet assembly that can serve as a primary faucet installation that is also configured to readily dispense filtered water at a desired temperature, whether chilled or heated, and carbonated water.

SUMMARY OF THE INVENTION

Examples of the present disclosure relates to a faucet assembly that can serve as the primary faucet system in a kitchen (or any other desirable location), such as a pull-down faucet with spray and sweep capabilities configured to dispense temperature-controlled liquid from hot and cold inlets, or an auxiliary faucet configured to dispense filtered water from a cold inlet. The faucet assembly is configured to dispense a variety of liquid types and temperatures readily, as disclosed below.

One example of a faucet assembly is configured for installation into a single hole installation in a surface. In such examples, the faucet assembly comprises a spout, a base, a puck, and a dispensing appliance. The spout defines an internal channel through which liquids pass, entering the spout from the dispensing appliance and exiting the spout at an outlet. The spout may further comprise an extendable sprayhead, wherein a user can extend the reach of the spout. The puck and the spout are affixed to the base.

In one example, the puck comprises a user interface and a wheel. The wheel can be physically manipulated, such as by turning clockwise or counterclockwise to control settings of the faucet assembly, such as water type, water temperature, rate of fluid being dispensed, volume of primary water to dispense, and/or other setting such as carbonation level, boiling water temperature, chilled water temperature, or combinations thereof. In another example, instead of a wheel, one or more buttons can be actuated to control the settings of the faucet assembly. In yet another example, a combination of a wheel and one or buttons or sensors can be rotated, pressed, or otherwise actuated to control the settings of the faucet assembly.

The user interface in any of the examples can have a variety of configurations, dependent on the configuration of the dispensing appliance. In one example, the user interface has one or more buttons that can be manipulated by a user as described above. In an alternative example, the user interface can additionally comprise a display screen, which is configured to display alerts, warnings, data, or other information. In one example, the display screen is a touch screen used for input to control the settings of the faucet assembly.

The dispensing appliance is configured to deliver liquids to the spout of the faucet assembly. This may include standard tap water, hot/cold tap water, filtered water, boiling water, carbonated water, etc. The user interface controls the dispensing appliance either through a wired connection or a wireless connection. The dispensing appliance can be powered by electricity.

Another example of the present disclosure relates to a faucet assembly configured for multiple hole standalone installation. In this example, the spout and the puck are mounted in discrete holes on a surface. The puck and dispensing appliance are configured in substantially the same way described supra.

It is understood that the above general description is exemplary and explanatory only and is not restrictive of the system as claimed. The system can be capable of other examples and of being carried out in various ways. Alternative exemplary examples can relate to other features and combinations of features.

Figure 2:
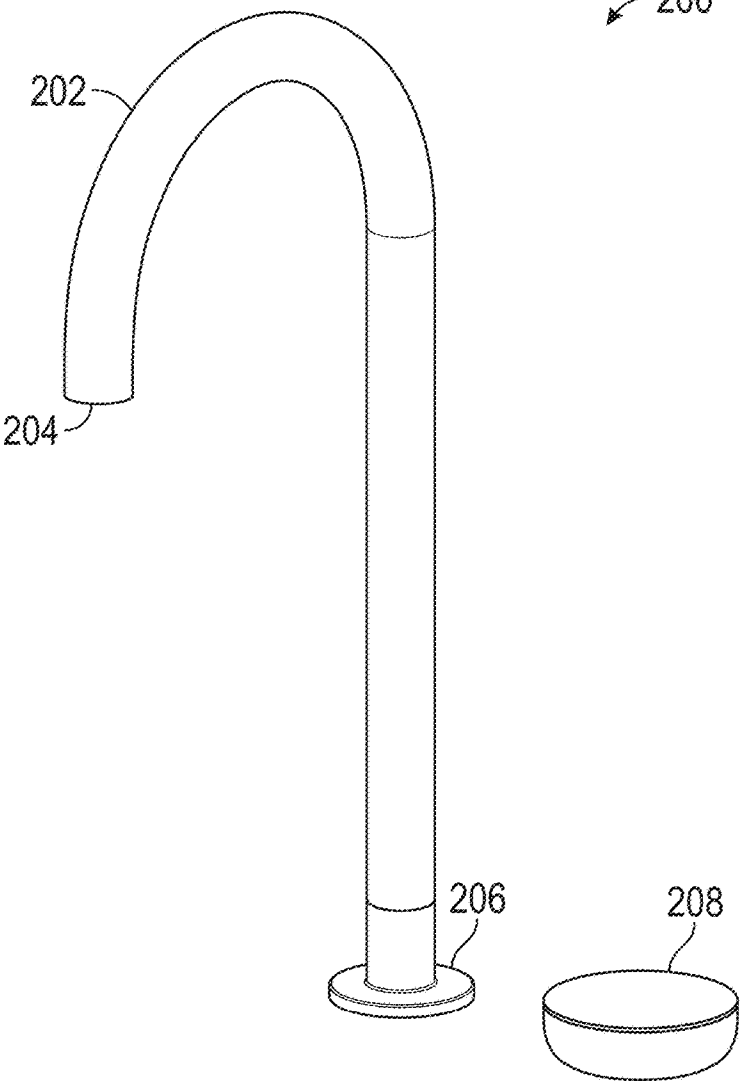
FIG. 2 is a perspective view of a faucet assembly, according to a second example configured for multiple hole standalone installation.

While various examples are amenable to various modifications and alternative forms, specifics thereof, have been shown by way of example in the drawings and will be described in detail. It should be understood, however, that the intention is not to limit the claimed disclosures to the particular examples described. On the contrary, the intention is to cover all modifications, equivalents, and alternatives falling within the spirit and scope of the subject matter as defined by the claims.

DETAILED DESCRIPTION

According to examples, a faucet assembly 100 generally can comprise a spout 102, a base 106, a puck 108, and a dispensing appliance (not pictured). The spout 102 defines one or more internal channels (not pictured) that can carry one or more liquids from the dispensing appliance through the faucet assembly 100 to an outlet 104 to be dispensed therefrom. In one example, the faucet assembly 100 can be a primary faucet for dispensing a temperature- and volume-controlled mix of hot and cold fluids and any or all of instant hot or boiling filtered water, chilled filtered water, and carbonated chilled filtered water. In another example, the faucet assembly can be an auxiliary faucet that only dispenses any or all of instant hot or boiling filtered water, chilled filtered water, and carbonated chilled filtered water.

In an example in which the faucet assembly 100 is a primary faucet, the spout 102 may further comprise an extendable sprayhead (not shown). The extendable sprayhead is affixed to the faucet assembly and can comprise a hose, which is housed in the internal channel of the spout 102. In examples with an extendable sprayhead, the outlet 104 is defined by the end of the extendable sprayhead. The extendable sprayhead can be removed from and redocked to the spout 102 by the user pulling and pushing the extendable sprayhead.

The hose can comprise multiple channels, such as a channel for delivering mixed unfiltered water, and a channel for delivering filtered water. The outlet 104 can comprise multiple channels (not shown) and spout 102 can include one or more diverters (not shown) for diverting fluid through one or more channels of the outlet 104. These channels define how the faucet assembly dispenses the liquids. For example, in one example, the outlet comprises two channels. One channel is a standard aerated flow defined by one outlet with a relatively large opening or a plurality of small channels. The other channel is a sweep spray defined by an arrangement of smaller openings arranged in a spray pattern. The two channels can be arranged at the outlet 104 in any suitable way. A user can select what channel to dispense liquids by manipulating a mechanical or digital valve at the outlet (not pictured).

Figure 3:
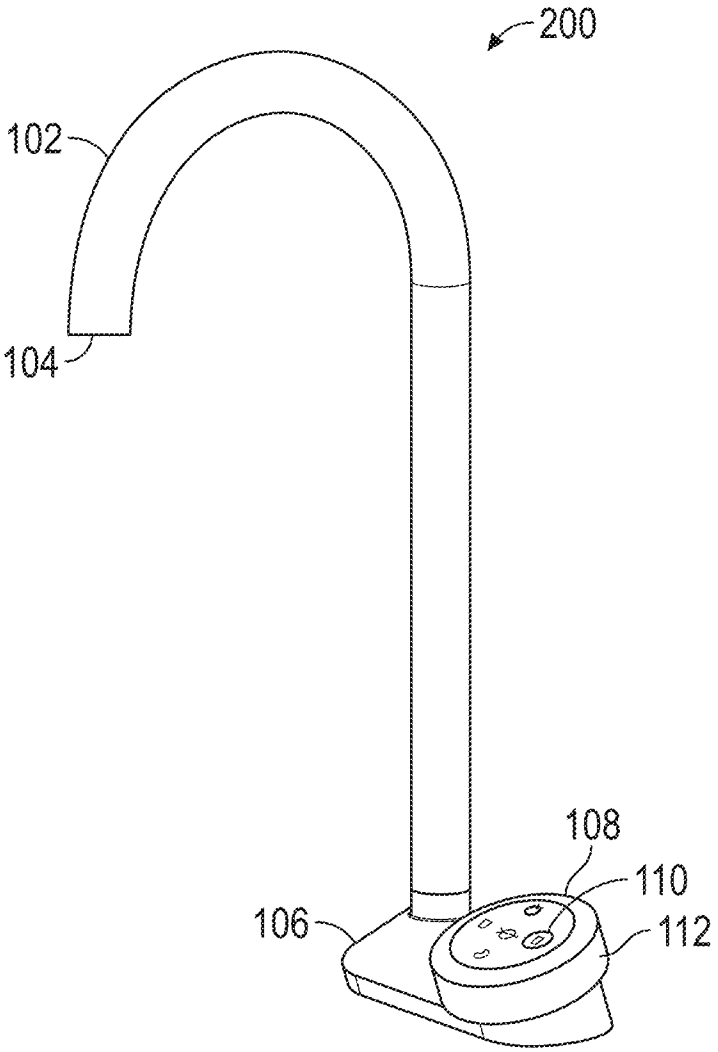
FIG. 3 depicts a faucet assembly, according to the first example having an electronic user interface.

Referring to FIG. 3, the puck 108 is wired to an under-counter assembly (500 in FIGS. 5 and 600 in FIG. 6) to power the puck 108 and provide communication between the puck 108 and the assembly 500,600. In examples, the puck 108 can comprise a user interface 110 and a wheel 112 and/or one or more buttons (not shown) and/or a touch screen (not shown), as described in the Summary According to examples, the puck 108 can provide haptic and/or visual feedback when the user interface is manipulated by the user. For example, an icon can light up when it is selected. The haptic feedback can be a vibration or a pulse, in any desired pattern when the icon is selected. The puck 108 can be configured to give haptic feedback patterns based on different inputs or outputs of the system. For example, the user interface can provide haptic feedback when the user presses the buttons to change the dispensing mode or activate water flow. The user interface may also provide haptic feedback when the user manipulates the wheel of the user interface, or touches an icon or other character on a touch screen.

Referring back to FIG. 1, one example of the faucet assembly 100 is configured for installation into a singular hole in a surface. Referring to FIG. 2, a second example of the faucet assembly 200 is configured for installation into multiple holes in a surface, such that the base 206 and the puck 208 are installed into discrete holes. Both examples dispense liquids from the dispensing appliance.

A variety of liquids can be readily available for dispensing by the faucet assemblies described herein. For example, in an example in which the faucet assembly 100 comprises a primary faucet, unfiltered water can be dispensed at a desired temperature, controlled, for example, via the wheel 112 of the puck 108. Filtered water, heated or chilled, can be dispensed by selecting the corresponding switch on the user interface 110 of the puck 108. Similarly, chilled carbonated water or sparkling water (lower carbonation) can be dispensed by selecting the corresponding switch on the user interface 110 of the puck 108.

Figure 4A:
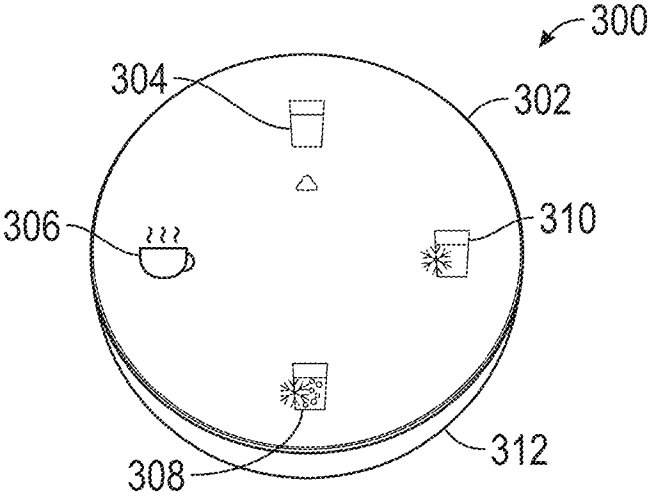
FIG. 4A-4C depicts a user interface of the faucet assembly, according to an example.

Referring to FIG. 4A, a puck 300 can be configured according to the configuration of the dispensing appliance. In one configuration, the puck 300 comprises a user interface 302 and a wheel 312. The user interface 302 can comprise four discrete buttons that are configured to control what liquid the faucet assembly dispenses when manipulated by a user. For example, a first button 304 dispenses ambient tap water. A second button 306 dispenses boiling (or heated) filtered water. A third button 308 dispenses chilled carbonated water. A fourth button 310 dispenses chilled filter water. The arrangement of these buttons is only exemplary. Other arrangements are acceptable, depending on configuration of the dispensing appliance.

The wheel 312 can be manipulated by the user to control a variable of the dispensing water, such as temperature and/or flow rate. For example, manipulating the wheel 312 to rotate in the clockwise direction can increase the temperature or flow rate of the dispensed water. Manipulating the wheel 312 to rotate in the counterclockwise direction can result in the opposite effect, a decrease in the temperature or flow rate of the dispensed water. In some examples, rotating the wheel can also be used to adjust carbonation level and boiling and/or chilled temperature settings of filtered water, in addition to the flow rate and temperature control of the unfiltered water.

In another example, a puck 400 comprises a user interface 402 and a wheel 414. The user interface 402 can comprise a plurality of discrete buttons in combination with wheel 414 or as an alternative to the wheel, and a display 412. Like the user interface 300 depicted in FIG. 4A, the buttons of user interface 402 correspond to one liquid type that the dispensing appliance can dispense. A first button 404 can dispense hot/boiling water. A second button 406 can dispense chilled and carbonated water. A third button 410 can dispense chilled and filtered water. A fourth button 408 can dispense ambient temperature water. This configuration is intended to only be exemplary. The wheel 414 can be configured to operate in substantially the same way as the wheel of FIG. 4A.

The display 412 can depict status updates or alerts for the faucet assembly. For example, in the depicted example, the display 112 can convey the temperature of the water being dispensed. In alternative examples, the display 112 can communicate other alerts or warnings, such as the water filter (not pictured) is approaching maximum capacity, components of the dispensing appliance need to be replaced, the detection of a leak, faulty pressure or temperature settings, or poor incoming water quality.

Figure 4B:
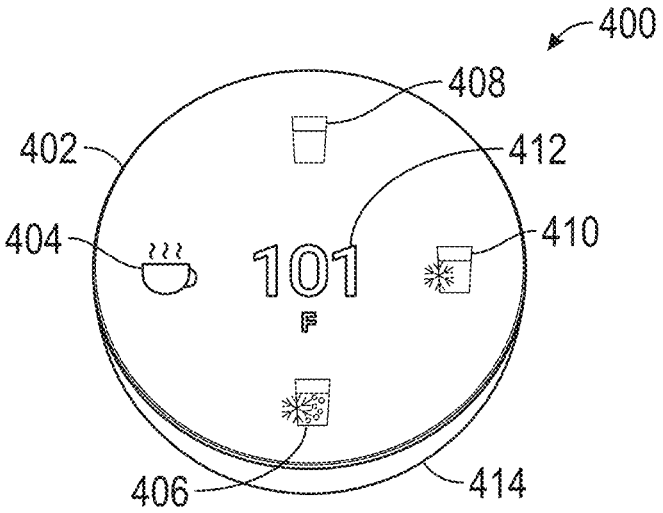
Figure 4C:
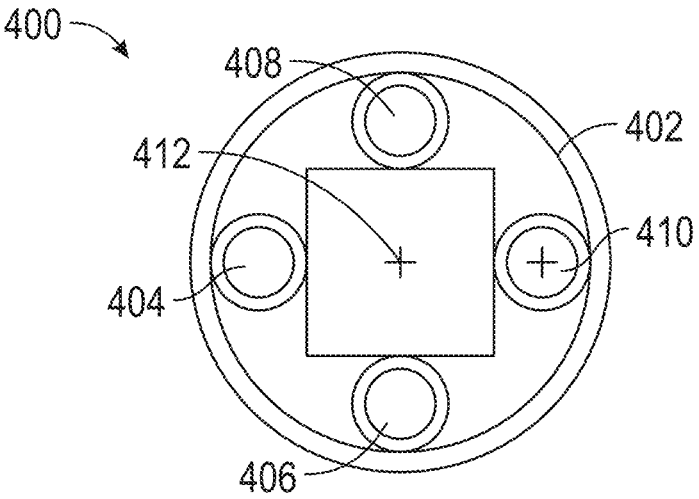

The user interfaces of FIG. 4A and FIG. 4B are configured with capacitive touch zones as the discrete buttons. Referring to FIG. 4C, these capacitive touch zones are how a user "presses" the buttons. Each button is defined by a capacitive touch zone 404, 406, 408, 410. Instead of a mechanical switch, the user touches the capacitive touch zone to trigger a digital switch, which communicates with the dispensing appliance. The user interface can additionally be configured with an OLED PCB (organic light emitting diode printed circuit board) board 412, or other advanced display type. The OLED PCB board 112 functions as the display depicted in FIG. 4B, enabling the user interface to display alerts or warnings to users. The user interfaces can be powered by electricity and are in communication with the dispensing appliance, wired or wireless.

Alternative examples may be configured with other suitable methods to achieve a similar functionality of the user interface 110. For example, instead of traditional capacitive touch zones described supra, the user interface can be configured with metal over capacitance buttons. In such an example, when the user presses a button on the user interface 110, the user interface 110 can deform slightly, creating a detectable change in the sensor capacitance. This may be a desirable in an example that is not equipped with haptic feedback. In another example, the user interface 110 comprises a touch screen, in which touching the screen in a defined location or on a specific icon to control the functionality of the faucet assembly.

The dispensing appliance of the faucet assembly can be configured to dispense instant hot (or boiling) water, instant chilled still water, instant chilled sparkling water, and instant chilled carbonated water.

Figure 1:
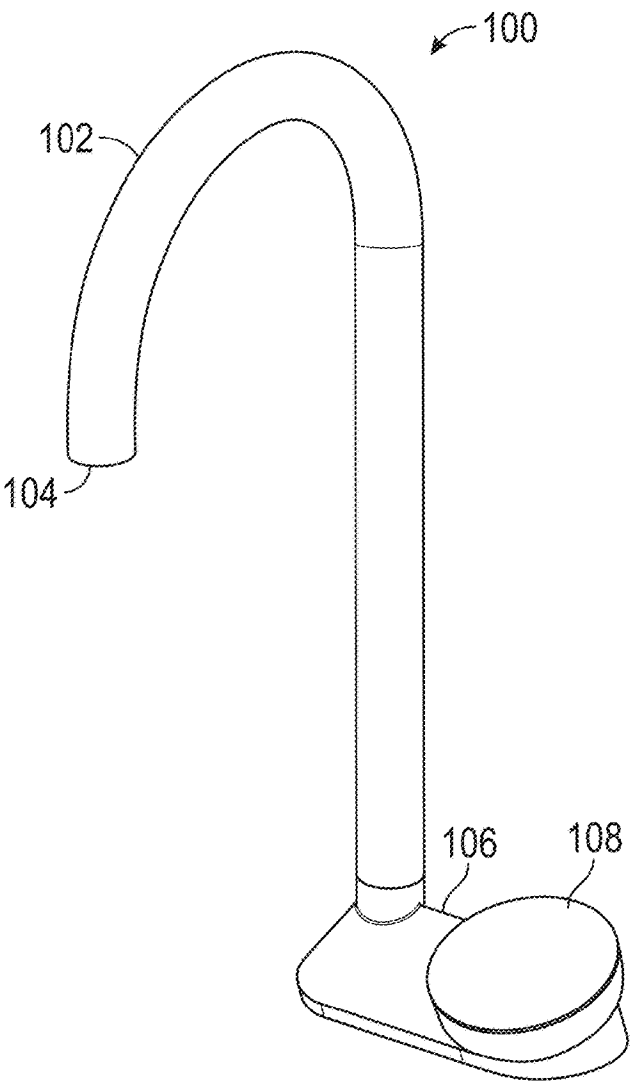
FIG. 1 is a perspective view of a faucet assembly, according to a first example configured for single hole installation with an escutcheon.
Figure 5:
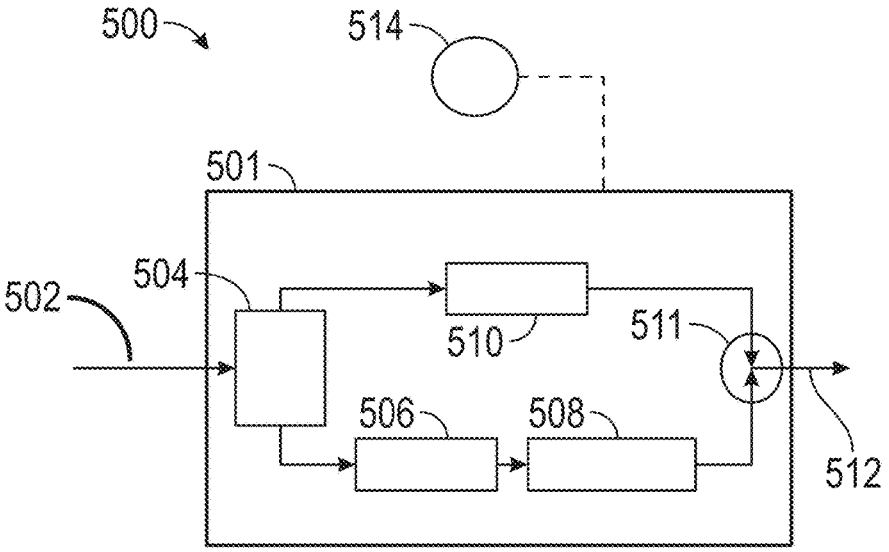
FIG. 5 is a diagram an auxiliary dispensing appliance of a faucet assembly, according to an example.

Referring to FIG. 5, a dispensing appliance 500 includes an undercounter assembly 501 for delivering a desired fluid type via fluid outlet 512, such as the faucet 100 (FIG. 1). In this example, dispensing appliance 500 comprises an auxiliary faucet, such as a bar or beverage faucet. The dispensing appliance 500 draws water from a cold-water inlet 502. In some examples, this inlet 502 can be ambient tap water. The dispensing appliance 500 comprises at least a filter assembly 504, a chiller 506, and a heater 510. The dispensing appliance 500 is configured to power and communicate with a puck 514 (as previously described) of a faucet assembly (not shown) wired to the dispensing appliance 500. After the dispensing appliance 500 takes in water from the inlet 502, the water moves through the filter assembly 504 and then to either the chiller 506 or the heater 510, depending on user input from a user interface (not shown) which actuates a valve, such as a solenoid valve (not shown). For example, when the user presses a button on the user interface to dispense chilled filter water, the dispensing appliance 500 will draw water from the water inlet 502 and direct the water through the filter assembly 504 to the chiller 506 via one or more actuated electronic solenoid valves. In another example, when the user presses a button on the user interface to dispense instant hot or boiling water, the dispensing appliance 500 will draw water from the water inlet 502 and direct the water through the filter assembly 504 to the heater 510 via one or more actuated electronic solenoid valves. The dispensing appliance 500 can further comprise a carbonator 508. The carbonator 508 can comprise known examples in the art, which can include a replaceable cannister of pressurized carbon dioxide (not shown), configured to infuse water with carbonation. After the dispensing appliance 500 processes the water according to the input from the user, the processed water exits undercounter assembly 501 as either a filtered chilled and/or carbonated stream or a heated stream, which join at tee 511, which can be dispensed from the dispensing appliance 500 through the water outlet 512 connected to the faucet.

Figure 6:
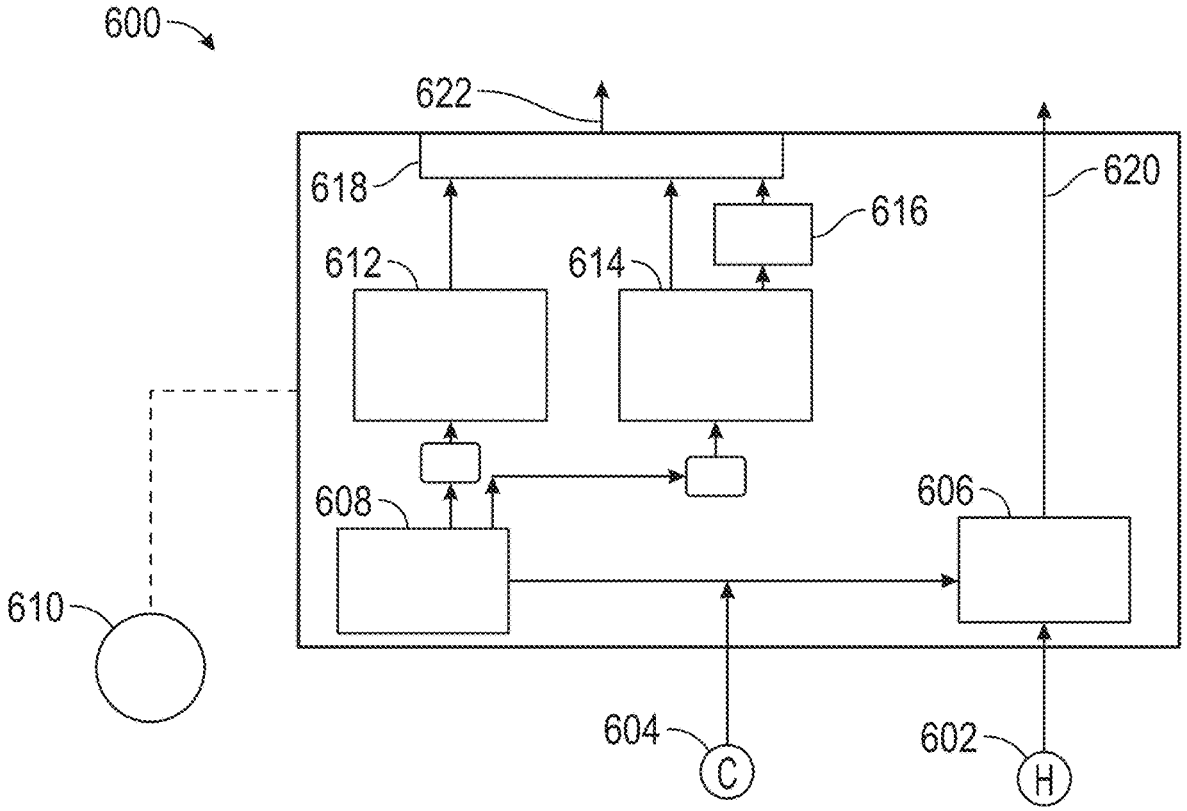
FIG. 6 is a diagram a primary dispensing appliance of a faucet assembly, according to another example.

Referring to FIG. 6, in an alternative example in which the fluid outlet is coupled to a primary faucet with optional extendable sprayhead as described above, a dispensing appliance 600 comprises at least a filter assembly 608, a digital valve 606, a hot unit 612, a cold unit 614, and a carbonator 616. The dispensing appliance 600 is configured to power and communicate with a puck 610 of a faucet assembly (not shown) via a wired connection. The dispensing appliance 600 has two water inlets, one unfiltered cold water inlet 604 and one unfiltered hot water inlet 602. The hot water inlet 602 can source its water from a water heater (not shown). The dispensing appliance 600 can dispense water to two outlets of the faucet assembly: a primary outlet stream 620 and a filtered outlet stream 622. The primary outlet stream 620 is connected to the faucet assembly, which can be configured to dispense water, either hot, cold, or mixed, in an aerated or sweep stream as described supra. The filtered outlet stream 622 can be coupled to an auxiliary faucet assembly (not shown), or can be delivered through a separate channel in a hose of the primary faucet.

When the dispensing appliance 600 is dispensing unfiltered water from the inlets, the dispensing appliance 600 can control the temperature of the water dispensed through the primary outlet stream 620 via one or more digital valves. The user of the faucet assembly manipulates the temperature by prompting certain commands on a puck (not shown). When the dispensing appliance 600 is dispensing filter water, the water can be hot, cold, sparkling, and/or carbonated. The dispensing appliance 600 draws water from the cold water inlet 604 and sends it through the filter assembly 608. Depending on the desired temperature and/or type selected, the water is next sent either the hot unit 612 or the cold unit 614 via actuation of one or more solenoid valves. The hot unit 612 can be configured to dispense boiling or instant hot water readily. If the water is sent to the cold unit 614, it can be further sent to the carbonator 616 or not. In the carbonator 616, as described supra, the water is infused with carbonation such that when the faucet assembly dispenses the water, it is chilled and sparkling or carbonated depending on the desired carbonation selected by the user. When the dispensing appliance 600 dispenses filtered water, the filtered water exits as either a filtered heated stream or filtered chilled and optionally carbonated stream, which join at tee 618 to form the filtered outlet stream 622 connected to the faucet.

The disclosure may be embodied in other specific forms without departing from the essential attributes; therefore, the illustrated examples should be considered illustrative and not restrictive in all respects. The claims provided herein are to ensure adequacy of the present application for establishing foreign priority and for no other purpose.

Various examples of systems, devices, and methods have been described herein. These examples are given only be way of example and are not intended to limit the scope of the claimed disclosures. It should be appreciated, moreover, that the various features of the examples that have been described may be combined in various ways to produce numerous additional examples. Moreover, while various material, dimensions, shapes, configurations, locations, etc. have been described for use with disclosed examples, others besides those disclosed may be utilized without exceeding the scope of the claimed disclosures.

Persons of ordinary skill in the relevant arts will recognize that the subject matter hereof may comprise fewer features than illustrated in any individual example described above. The examples described herein are not meant to be an exhaustive presentation of the ways in which the various features of the subject matter hereof may be combined. Accordingly, the examples are not mutually exclusive combinations of features; rather, the various examples can comprise a combination of different individual features selected from different individual examples, as understood be persons of ordinary skill in the art. Moreover, elements described with respect to one example can be implemented in other examples even when not described in such examples unless otherwise noted.

Any incorporation of reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

What is claimed:

1. A faucet assembly comprising:

a faucet including a faucet body and a spout;

a fluid dispensing apparatus configured to dispense a fluid to the faucet body for output at the spout, wherein the fluid dispensing apparatus comprises a water inlet and a plurality of fluid processing components to provide a plurality of fluid characteristics to the fluid; and a control unit operably coupled to the fluid dispensing apparatus, the control unit having a user interface comprising:

a display configured to depict temperature, status updates, alerts, or warnings;

a plurality of capacitive touch zones surrounding the display, each of the capacitive touch zones configured to be operable by a user to select a fluid characteristic from the plurality of fluid characteristics; and a rotatable wheel operable to control a setting of the output of faucet assembly.

2. The faucet assembly of claim 1, wherein the fluid dispensing apparatus comprises a filter apparatus, a chiller, a heater, a carbonator, or any combination thereof, and wherein the plurality of fluid characteristics comprise filtered chilled water, filtered chilled sparkling water, filtered chilled sparkling carbonated water, filtered instant hot water, or combinations thereof.

3. The faucet assembly of claim 2, wherein the water inlet comprises an unfiltered cold water source, and wherein the water inlet is coupled to the filter apparatus, and the filter apparatus is coupled to at least one of the chiller, heater, and carbonator.

4. The faucet assembly of claim 3, wherein the fluid dispensing apparatus further comprises an unfiltered hot water source, and a valve configured to control a flow of unfiltered hot and cold water to the spout for dispensing.

5. The faucet assembly of claim 1, wherein the rotatable wheel is configured to be operable to control settings of the faucet assembly selected from the group consisting of water temperature, flow rate, and volume of fluid to dispense.

6. The faucet assembly of claim 1, wherein the control unit is in wired connection to the fluid dispensing apparatus.

7. The faucet assembly of claim 6, wherein the control unit is remote from the faucet body.

8. The faucet assembly of claim 6, wherein the faucet body is mounted to a base, and the control unit is mounted to one of the faucet body and the base.

9. The faucet assembly of claim 3, wherein the faucet is an auxiliary faucet.

10. A fluid dispensing apparatus configured to deliver a fluid having a fluid characteristic to a dispensing faucet, the fluid dispensing apparatus comprising:

a plurality of fluid processing components comprising a filter apparatus, and at least one of a heater, a chiller, and a carbonator to provide a plurality of fluid characteristics to the fluid; and a control unit operably coupled to the fluid dispensing apparatus, the control unit having a user interface comprising:

a display configured to depict temperature, status updates, alerts, or warnings;

a plurality of capacitive touch zones surrounding the display, each of the capacitive touch zones configured to be operable by a user to select a fluid characteristic from the plurality of fluid characteristics; and a rotatable wheel operable to control a setting of the output of faucet assembly.

11. The fluid dispensing apparatus of claim 10, wherein the plurality of fluid characteristics comprises filtered chilled water, filtered chilled sparkling water, filtered chilled carbonated water, and filtered instant hot water.

12. The fluid dispensing apparatus of claim 10, wherein an unfiltered cold water source, is coupled to the filter apparatus, and the filter apparatus is coupled to at least one of the chiller, heater, and carbonator.

13. The fluid dispensing apparatus of claim 10, wherein the rotatable wheel is configured to be operable to control settings of the faucet assembly selected from the group consisting of water temperature, flow rate, and volume of fluid to dispense.

14. The fluid dispensing apparatus of claim 13, wherein the user interface is actuated by a plurality of capacitive sensors, buttons, or a combination thereof, to select the water characteristics, to select a setting of a selected water characteristic, or both.

15. The fluid dispensing apparatus of claim 13, wherein the puck is configured to provide haptic feedback, visual feedback, or both when the puck is manipulated between fluid characteristic settings on the user interface.

16. A method of dispensing a fluid from a faucet, the method comprising:

providing a fluid dispensing apparatus configured to deliver a fluid having a fluid characteristic to a dispensing faucet, wherein the fluid dispensing apparatus comprises a filter apparatus, and a least one of a heater, a chiller, and a carbonator;

providing a control unit operably coupled to the fluid dispensing apparatus, the control unit having a user interface comprising:

a display configured to depict temperature, status updates, alerts, or warnings;

a plurality of capacitive touch zones surrounding the display, each of the capacitive touch zones configured to be operable to select a fluid characteristic from the plurality of fluid characteristics; and a rotatable wheel operable to control a setting of the output of faucet assembly, the wheel rotatable with respect to the display; and causing the fluid having the selected fluid characteristic to be processed by the fluid dispensing apparatus and dispensed from the faucet.

17. The method of claim 16, wherein the plurality of fluid characteristics comprises filtered chilled water, filtered chilled sparkling water, filtered chilled carbonated water, and filtered instant hot water.

18. The faucet assembly of claim 1, wherein the wheel is rotatable with respect to the display.

19. The fluid dispensing apparatus of claim 10, wherein the wheel is rotatable with respect to the display.

20. The method of claim 16, wherein the wheel is rotatable with respect to the display.

* * * * *